US009237787B2

(12) United States Patent
Lam et al.

(10) Patent No.: US 9,237,787 B2
(45) Date of Patent: Jan. 19, 2016

(54) HAIR STYLING IRON WITH TIMER

(75) Inventors: Wai Ming Lam, Hong Kong (HK); Wai Ho Michael Keong, Hong Kong (HK)

(73) Assignee: KENFORD INDUSTRIAL COMPANY LTD., New Territories, Hong Kong (CN)

( * ) Notice: Subject to any disclaimer, the term of this patent is extended or adjusted under 35 U.S.C. 154(b) by 0 days.

(21) Appl. No.: 13/980,199

(22) PCT Filed: Oct. 26, 2011

(86) PCT No.: PCT/CN2011/081323

§ 371 (c)(1),
(2), (4) Date: Aug. 6, 2013

(87) PCT Pub. No.: WO2012/097619

PCT Pub. Date: Jul. 26, 2012

(65) Prior Publication Data

US 2013/0306099 A1 Nov. 21, 2013

(30) Foreign Application Priority Data

Jan. 18, 2011 (CN) ..... 2011 2 0017359 U

(51) Int. Cl.
*A45D 1/04* (2006.01)
*A45D 1/00* (2006.01)
(Continued)

(52) U.S. Cl.
CPC .. *A45D 1/00* (2013.01); *A45D 1/04* (2013.01); *A45D 1/16* (2013.01); *A45D 1/28* (2013.01); *A45D 6/02* (2013.01); *A45D 6/04* (2013.01)

(58) Field of Classification Search
CPC ..... A45D 1/04; A45D 6/02; A45D 6/04; A45D 2/32; A45D 1/00; A45D 1/06; A45D 1/16; A45D 1/28
USPC ..... 132/223, 224, 226, 227, 229, 232, 132/237–239, 269, 271, 119.1; 219/222, 219/225, 248; 242/563, 563.2, 564.1, 390.8
See application file for complete search history.

(56) References Cited

U.S. PATENT DOCUMENTS 3,605,762 A * 9/1971 Fromman ..... 132/238
4,824,036 A * 4/1989 Buta ..... 242/442
(Continued)

FOREIGN PATENT DOCUMENTS

CN 2768540 Y 4/2006
CN 201025960 Y 2/2008
WO WO 2010/057038 * 5/2010 ..... A45D 2/00

OTHER PUBLICATIONS

State Intellelctual Property Office of the People's Republic of China, International Search Report in International Patent Application No. PCT/CN2011/081323 (Feb. 9, 2012.

*Primary Examiner* — Robyn Doan
*Assistant Examiner* — Tatiana Nobrega
(74) *Attorney, Agent, or Firm* — Leydig, Voit & Mayer, Ltd.

(57) ABSTRACT

A hair styling iron has a handle to which a heated barrel is mounted and a motor for moving the barrel. The iron includes a drive switch which is user actuable and connected to the control circuit for controlling operation of the motor. The control circuit includes a timer and monitors at least one change of state of the user-actuable drive switch to determine a starting time, and actuates an alarm, or another response, such as a reversal of the motor to unwind the hair, after an elapsed time measured from the starting time. The elapsed time may be user-selected or calculated automatically depending upon the length of hair wound onto the barrel, with compensation for barrel temperature.

22 Claims, 2 Drawing Sheets

(51) Int. Cl.

| | |
|---|---|
| ***A45D 1/28*** | (2006.01) |
| ***A45D 1/16*** | (2006.01) |
| *A45D 6/02* | (2006.01) |
| *A45D 6/04* | (2006.01) |

(56) References Cited

U.S. PATENT DOCUMENTS

| | | | | |
|---|---|---|---|---|
| 4,968,870 | A | 11/1990 | Moon | |
| 5,649,555 | A * | 7/1997 | Harris | 132/238 |
| 5,951,894 | A | 9/1999 | White, Jr. | |
| 6,962,159 | B1 * | 11/2005 | Adam | 132/210 |
| 8,132,571 | B1 * | 3/2012 | Jackson | 132/211 |
| 2003/0052115 | A1 * | 3/2003 | Leung | 219/222 |
| 2005/0011533 | A1 * | 1/2005 | Ruben | 132/230 |
| 2005/0098192 | A1 * | 5/2005 | Cafaro | 132/232 |
| 2006/0191888 | A1 * | 8/2006 | Carlucci | 219/225 |
| 2006/0237418 | A1 * | 10/2006 | Bousfield et al. | 219/225 |
| 2008/0104787 | A1 * | 5/2008 | Keenan et al. | 15/210.1 |
| 2009/0139093 | A1 * | 6/2009 | Moreschini | 30/30 |
| 2012/0111357 | A1 * | 5/2012 | Amkie | 132/230 |
| 2013/0025620 | A1 | 1/2013 | Keong et al. | |

* cited by examiner

HAIR STYLING IRON WITH TIMER

TECHNICAL FIELD

The present invention relates to electric irons for thermal shaping and styling of hair, and particularly irons with a timer for indicating treatment time to the user.

BACKGROUND OF THE INVENTION

Hair styling irons having an electrically heated elongate tool are well-known, and commonly used for curling or straightening hair. One of the challenges facing the users of such appliances, particularly for professionals, is how to most efficiently achieve a desired styling effect. A number of factors influence the effectiveness of heat to shape the hair, these include intrinsic properties of an individual's hair, treatments agents applied to the hair (such as water or other softening agents), the time and temperature of the heat application, as well as the manner in which the hair iron is used (the size of a tress which is treated, the tension applied to the hair etc). Consistent results can be obtained most efficiently if these factors can be kept relatively constant for a specific treatment or if, for instance, they can be varied incrementally to provide a different level of treatment, however in the past this has been somewhat problematic. In particular, processing results can be variable if the operation is performed too fast, the processing time is too short and, therefore, the hair is not properly formatted, while processing hair for too long can damage the hair by overheating.

To address these issues it is known to provide hair curling irons with a timer to indicate an elapsed time from the start of the timer. US2006/0191888 describes a hair iron in which time and temperature are coordinated, and in which the user selects settings for the iron temperature and a desired curl tightness. The elapsed time is controlled such that for a selected curl tightness, the elapsed time is decreased with increasing temperature. However, there are drawbacks with this device associated with its ease of use. In operation, it requires the user to remember to start the timer by pressing a start button each time the iron is used, and for consistent results this button must be pressed at the same stage of the operation each time. Particularly when manipulating the iron behind the head it may be difficult to locate and press the start button. Moreover, programming the controller is a complex operation, in which three different buttons must also be operated to increase and decrease the settings for the timer. There is therefore a need for a hair styling iron having a timer which can be more readily used.

A further disadvantage of the curling iron of US2006/0191888 is that the coordination between time and temperature in this prior art manner takes no account of the mass of hair being curled, and the fact that the heat required increases with the mass of hear being curled. At any selected temperature a short tress is formatted more quickly than a longer tress, with the result that a short tress may be overheated, while a long tress is under-heated. There is a need for a hair styling iron having a timer which can mitigate this source of variability, to help users produce good results more predictably.

It is an object of the present invention to overcome or substantially ameliorate the above disadvantages or more generally to provide an improved electric hair styling iron.

DISCLOSURE OF THE INVENTION

In one aspect the invention provides a hair styling iron comprising:

a handle to which a barrel is mounted, a heating element in the barrel;

a motorised means for moving the barrel;

a control circuit including a timer;

a drive switch which is user actuable and connected to the control circuit for controlling operation of the motorised means;

and wherein the control circuit monitors at least one change of state of the user-actuable drive switch to determine a starting time, and actuates a response after an elapsed time measured from the starting time.

By having the drive switch that operates the motorised means also serve to set a starting time, operation of the hair styling iron is simple for the user and component numbers can be reduced, while the ability to provide consistent hair styling results in a timely manner is improved. The response may comprise an alarm, particularly a tactile, audible or visual alarm disposed in the hair styling iron.

Preferably the motorised means comprises a rotary drive that rotates the barrel. Optionally the motorised means vibrates the barrel.

Preferably the rotary drive rotates the barrel in a first direction upon actuation of the drive switch, and the response initiated by the control circuit after the elapsed time comprises turning the barrel in a second direction, opposite to the first direction. Preferably the control circuit records a first angle of rotation in the first direction, and the barrel is driven in the second direction through a second angle that is proportional to the first angle. The second angle may be sufficient to loosen the hair from the barrel. The second angle may, for instance, be between 80 and 110 percent of the first angle to provide for the hair to be completely unwound from the barrel.

Preferably the drive switch provides on-off control of the motorised means and when turned on moves the barrel at a fixed rate. Optionally, the drive switch may provide for modulated control of the motorised means for moving the barrel at a variable, user-controlled rate, such as a rheostat type switch.

Preferably the drive switch is a momentary switch, the actuation of which must be maintained by the user in order to operate the motorised means. Preferably the drive switch is a push-to-make switch. The drive switch need not be a mechanical type in which the user presses on an operator or mechanism to move a contact, and instead sensor type switches having, for example, capacitive or optical sensing elements, could be used.

Either the actuation or the release of the drive switch may define the starting time. In one embodiment the change of state comprises the first actuation of the drive switch, and the control circuit actuates the tactile, audible or visual alarm after an elapsed time measured from the first actuation of the drive switch. In another embodiment the change of state comprises the release of the drive switch immediately following the first actuation of the drive switch, and the control circuit actuates the alarm after an elapsed time measured from the release of the drive switch.

The hair styling iron may operate either in a user-selected time mode or in an automatic time mode, or else it may operate selectively in either the user-selected time mode or in the automatic time mode. In the user-selected time mode the elapsed time is determined based upon user selections made before use, such as a timer setting or temperature setpoint. In the automatic time mode the control circuit calculates an elapsed time depending upon how the hair styling iron is actually used, to account for the amount of hair to be curled.

User-selected Time Mode

Preferably the control circuit further comprises timer setting means for allowing users to select one from a plurality of predetermined timer setting values, each associated with an elapsed time. Preferably the timer setting means comprises a timer setting switch connected to the control circuit.

Preferably the control circuit comprises a thermostat, and means for selecting one from a plurality of setpoint temperatures, and wherein each of the plurality of predetermined timer setting values is associated with both a respective elapsed time and a setpoint temperature.

Automatic Time Mode

Preferably the change of state comprises both the first actuation of the drive switch, and the release of the drive switch immediately following the first actuation of the drive switch, and the control circuit actuates the alarm after an elapsed time which is calculated by the control circuit in direct proportion to the angle of rotation of the barrel relative to the handle that occurs between the first actuation and the release of the drive switch.

If the rotary drive rotates the barrel at a constant speed when the drive switch is actuated, the angle of rotation of the barrel is directly proportional to the time between actuation and release of the drive switch, so the control circuit may monitor the switch-operating time between the actuation and release of the drive switch and calculate an elapsed time in direct proportion to the switch-operating time. In this way the elapsed time may be determined in proportion to the length of hair wound onto the barrel during operation of the drive switch.

Where the drive switch provides for modulated control of the rotary drive then the control circuit may include a rotary encoder for measuring the angle of rotation of the barrel or, for example, the angular speed of the barrel could be integrated by the controller to calculate the angle of rotation of the barrel.

Preferably the control circuit comprises a thermostat, and means for selecting one from a plurality of setpoint temperatures, and wherein the elapsed time which is calculated by the control circuit is varied in proportion to the setpoint temperature.

Preferably, if the motorised means vibrates the barrel, then the control circuit may stop the motorised means to provide the alarm. If the motorised means rotates the barrel the control circuit may rapidly reverse the motorised means to vibrate the barrel and thereby provide the alarm. The hair styling iron may include an alarm signal generator, such as a wireless alarm signal generator, for transmitting an alarm signal to a remote tactile, audible or visual alarm. However, preferably the control circuit includes a separate vibrator, audio emitter or a light source to provide the alarm after the elapsed time.

Preferably a display is connected to the control circuit. The display may indicate a user-selected temperature and/or a user selected timer setting.

The control circuit may operate the alarm to provide a preliminary tactile, audible or visual alarm immediately before the elapsed time. For instance, the preliminary alarm may comprise two temporally spaced activations of the indicator for relatively short discrete lengths of time, before operating for a relatively long length of time upon expiry of the elapsed time.

Preferably the alarm is a vibro-tactile device, for instance a rotary motor with an eccentrically mounted weight disposed in the handle for vibrating the handle.

Preferably the timer-setting switch comprises a single-pole, single-throw instantaneous contact switch mounted to the handle and it is operable to toggle through a set of timer settings.

In another aspect the invention provides a hair styling iron comprising:

a handle to which a barrel is mounted, a heating element in the barrel;

a clamp for urging hair into contact with the barrel;

a motorised means for rotating the barrel;

a control circuit including a timer;

a drive switch connected to the control circuit which is actuated by closing the clamp to urge the hair against the barrel;

and wherein the control circuit monitors at least one change of state of the drive switch to determine a starting time, and actuates a response after an elapsed time measured from the starting time.

In yet another aspect the invention comprises a method of curling air using a hair styling iron substantially as described above, comprising:

a) heating the barrel;

b) wrapping a tress around the barrel;

c) actuating the drive switch to wind the tress about the barrel, d) releasing the drive switch to stop the rotary drive, and e) awaiting an automatically generated alarm indicating the end of the elapsed time before removing the tress from the barrel.

The method may further comprise the step, prior to step c), of selecting one from a plurality of predetermined timer setting values, each associated with an elapsed time.

The method may further comprise the step of actuating a single button on the hair iron to select either (i) one from a plurality of predetermined timer setting values or (ii) an automatic time mode in which the elapsed time is calculated by the control circuit in direct proportion to the angle of rotation of the barrel relative to the handle that occurs between the first actuation and the release of the drive switch.

The method may further comprise the step, prior to step c), of selecting one from a plurality of setpoint temperatures, each of which defines a respective elapsed time.

The method may further comprise the step, prior to step c), of clamping the tress to the barrel.

Preferably the starting time coincides with the release of the drive switch.

In another aspect the invention provides a method of curling air using a hair styling iron as described above, comprising:

a) heating the barrel;

b) wrapping a tress around the barrel;

c) actuating the drive switch to wind the tress about the barrel in a first direction, d) releasing the drive switch to stop the rotary drive, e) receiving an automatically generated signal indicating the end of the elapsed time, and reversing the motorised means, in response to the automatically generated signal, to turn the barrel in a second opposing direction to unwind the tress from the barrel.

This invention provides a hair styling iron device and method which, by allowing a user to time a particular styling process in a simple manner, allows for more consistent styling results to be produced more efficiently. It will be understood that the invention may comprise any combination of the above-described features and is not limited to the specific features claimed according to the claim dependencies.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
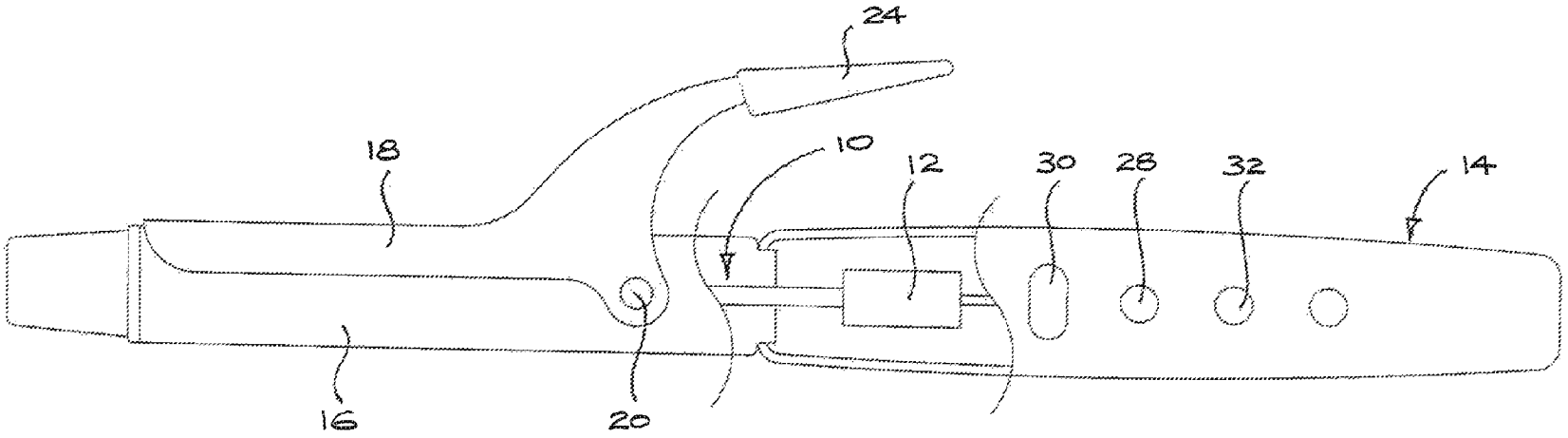
FIG. 1 is a partially cut away side view of a hair styling iron according to the invention.
Figure 2:
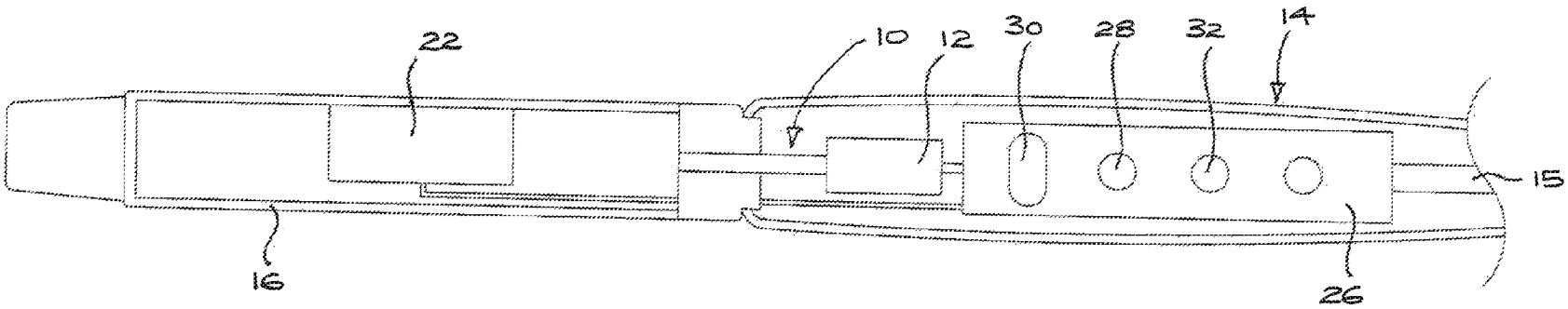
FIG. 2 is a fragmentary internal view of the hair styling iron of FIG. 1.

FIGS. 1 and 2 illustrate a hair styling iron according to the invention, which generally includes a curling spindle 10 and an elongate, hollow handle 14. The spindle 10 is turned by a DC gear motor 12 and includes an elongated, generally cylindrical curling barrel 16 that extends generally coaxially from one end the handle 14. The curling barrel 16 includes an electrical heating element 22 disposed in the curling barrel 16. A clamping member 18 may be an elongated element pivotably attached to the curling barrel 16 by a transverse pivot 20, and with a concave inner face generally complementary to the outer face of the curling barrel 16. The clamping member 18 may be biased by a spring (not shown) toward the barrel 16. A lever 24 may be fixed to the clamping member 18 for moving the clamping member between an open and closed position to enable retention and release of a strand of hair thereby.

Both the curling barrel 16 and handle 14 are hollow. The barrel 16 may have a plain surface, or may have other hair-engaging features such as protrusions, ribs, tines or bristles. The handle encloses a printed circuit board 26 to which the principal components of a control circuit 128 are disposed. The handle portion 14 of the styling iron 10 may be provided with a power cable 15 via which the control circuit 128 receives power. The control circuit 128 supplies current to the element 22, controlling the current according to the setpoint temperature level at which the curling barrel 16 is maintained and that is set by a thermostat switch 28. Thermostat switch 28 for setting the temperature may be an instantaneous contact type, operated as by individual actuations and releases stepping through a set of predefined temperature settings.

The control circuit further includes a rotational control switch 30 for initiating and terminating rotation of the spindle 10 in a selected direction 12; and a timer setting switch 32 for controlling timer operation. A display 124 may be connected to the control circuit 128 for indicating a user-selected setting (e.g. temperature, time, or the like). The display 124 may be active, including a light source such as a light emitting diode or the like, or it may be a passive display requiring outside illumination. The rotational control switch 30 may be an instantaneous reversing switch (double-pole, double-throw) which must be maintained actuated to operate the motor 12. The timer setting switch 32 may be an instantaneous contact type, operated as by individual actuations and releases stepping through a set of predefined settings shown on the display 124. A button (not shown) may make it possible to adjust the rotation speed of the spindle 10

A vibro-tactile indicator 36 may be employed to provide a response in the form of tactile alarm at the end of the elapsed time measured from a starting time. The vibro-tactile indicator 50 may comprise a motorised eccentric-type vibrator fixed inside the handle, such that the user is able to sense vibration of the handle 14 after the elapsed time. The vibro-tactile indicator 50 may be driven continuously or discontinuously to provide an alarm to indicate the elapsed time.

A main controller 38 is operatively connected to the display 124, the rotational control switch 30, thermostat switch 28 and timer-setting switch 48. Also connected to the main controller 38 are a motor controller 40, timer controller 42 and temperature controller 44 for respectively controlling the motor 12, vibro-tactile indicator 36 and heating element 22.

In operation of the styling iron, after connection to a power supply the thermostat switch 28 can be adjusted to select an appropriate temperature, typically a high, medium or low level. In a first embodiment the timer setting switch 32 is present, and allows the user to select one of, for instance, three timer settings for short, medium and long time, each defining a respective elapsed time. In a second embodiment the timer setting switch 32 may be present or absent. If present, timer setting switch 32 may allow a user to select between two modes: a first user-selected mode providing for selection of an elapsed time between predefined timer settings and a second automatic mode in which the elapsed time is determined automatically. If the timer setting switch 32 is absent, the elapsed time is determined automatically by the control circuit 128.

In order to curl hair, the clamp actuating lever 24 is depressed so as to open the clamping member 18. A portion of a tress is inserted beneath the clamping element and the lever is released so as to retain the strand of hair. The rotational control switch 30 is then activated so as to rotate the spindle 12 to wind the hair thereabout and then released when the desired length of hair has been wound up. Any one of these actions may serve to start the timer automatically. For instance, a switch (not shown) actuated by movement of the clamping member 18 toward the barrel 16 may send a starting time signal to the timer controller 42. However, preferably the timer is started automatically by the main controller 38 monitoring a change of state of the rotational control switch 30. When the main controller 38 identifies the release of the rotational control switch 30 immediately following the first actuation of the rotational control switch 30, the controller sends a starting time signal to the timer controller 42 to define the starting time.

In the user-selected time mode, the timer is started automatically as by monitoring a change of state of the rotational control switch 30. When the timer controller 42 receives the starting time signal a countdown is initiated and runs for an elapsed time associated with the timer setting selected by the user, before sending an actuation signal to generate a response, such as an alarm provided by the vibro-tactile indicator 36 at the end of the elapsed time. In this user-selected time mode the timer setting alone may not define the elapsed time. The elapsed time may be determined by the control circuit based upon both the timer setting and the setpoint temperature. For instance, for any one timer setting, a low setpoint temperature may be associated with a longer elapsed time than a high setpoint temperature.

In the automatic time mode, the elapsed time is varied to account for the length of hair wound about the curling barrel 16. The rotary gear motor 12 may rotate the barrel 16 at a constant speed when the rotational control switch 30 is actuated, so that the angle of rotation of the barrel 16 is thus directly proportional to the time between actuation and release of the rotational control switch 30. The motor controller 40 monitors the time between the actuation and release of the rotational control switch 30 during which time the motor 12 is operated and sends a feedback signal to the timer controller 42 which is indicative of the angular rotation of the barrel 16 during the time the motor 12 is operated. The timer controller 42 then calculates an elapsed time in direct proportion this switch-operating time. When the main controller 38 identifies the release of the rotational control switch 30 immediately following the first actuation of the rotational control switch 30, the controller sends a starting time signal to the timer controller 42 to define the starting time. Starting from the calculated elapsed time a countdown is initiated before sending an actuation signal to generate a response, such as an alarm provided by the vibro-tactile indicator 36 at the end of the elapsed time. By controlling the elapsed time for the timer and starting the timer in this manner the appropriate curling time can be indicated to the user, and increased in accordance with the mass of hair that is being curled.

Figure 3:
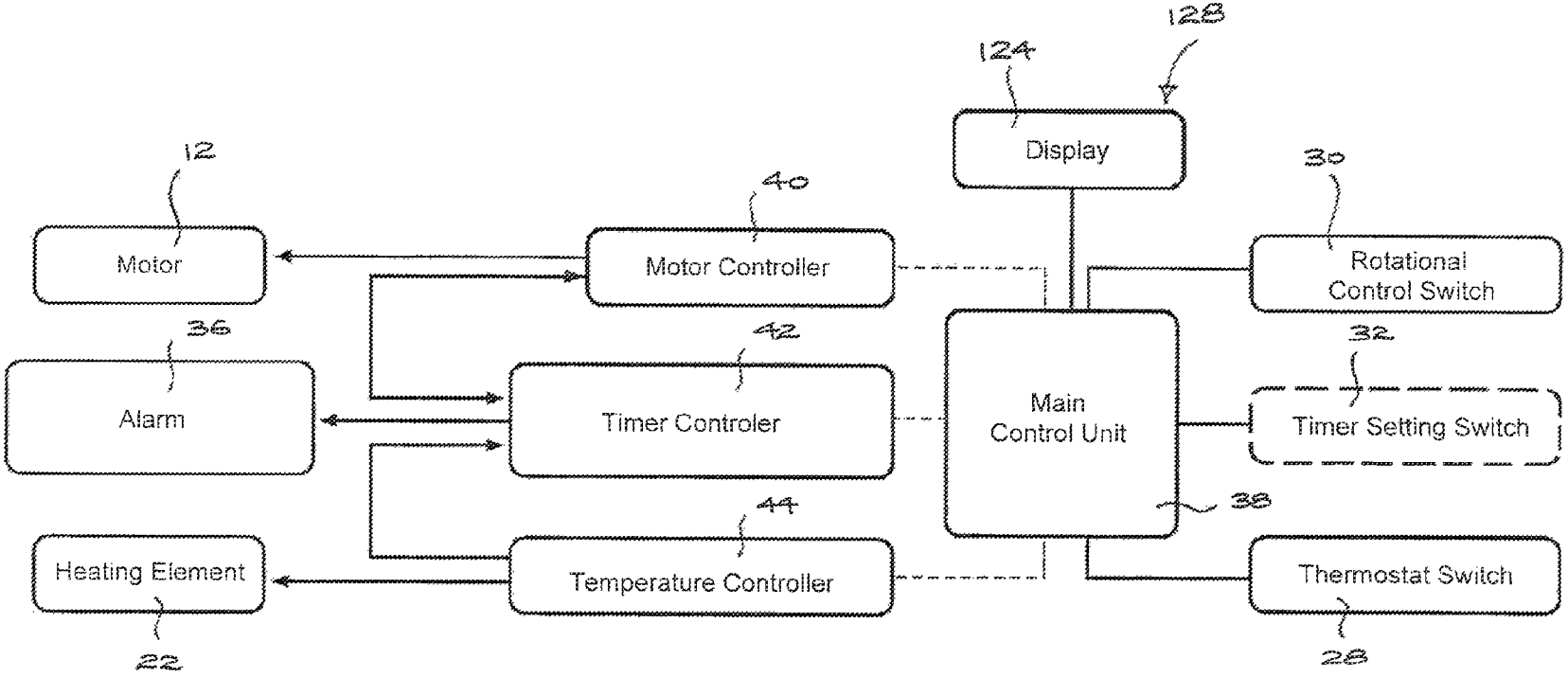
FIG. 3 is a block diagram of a control circuit of the hair styling iron of FIG. 1.

In the automatic time mode, the elapsed time may also be varied to account for the setpoint temperature. As shown in FIG. 3, the timer controller 42 receives feedback from the temperature controller 44 for this purpose. The timer controller 42 varies the calculated elapsed time in direct proportion to the setpoint temperature. At a high setpoint temperature the calculated elapsed time is reduced, compared to that determined for a low setpoint temperature.

After the elapsed time, the user is prompted by the vibro-tactile indicator 36 to press the rotational control switch 30 to reverse the direction in which the spindle 12 rotates so as to unwind the hair therefrom; the rotational control switch 30 is released to terminate rotation, and the clamp actuating lever is depressed so as to release the now curled strand of hair.

In both embodiments and in both the user-selected time mode and automatic time mode the rotary drive may rotate the barrel in a first direction upon actuation of the drive switch, and the response initiated by the control circuit after the elapsed time may comprise turning the barrel in a second direction, opposite to the first direction. In this manner, once the hair has been heat treated for the elapsed time the response provides that the hair is loosened or completely unwound from the barrel automatically. No user intervention is required to loosen or unwind the hair from the barrel. While the alarm preferably accompanies the automatic unwinding of the hair, the alarm is not needed to indicate the elapsed time to the user, as the reverse rotation of the barrel itself indicates to the user that the elapsed time has passed. Thus the alarm is not essential to all embodiments of the invention. The essential feature is generation of some automatic response at the end of the elapsed time, such as an alarm or the reverse rotation of the barrel, which indicates the end of the elapsed time.

It will also be understood that the manner in which the hair is unwound is not essential to the invention, and for instance the spindle 12 may simply be disengaged from the gear motor at the end of the curling time via a clutch (not shown) which is operated by the control circuit to provide the response and to allow the spindle to rotate freely, thereby unwinding the curled hair. Such a clutch may also provide torque limiting for optimal tensioning of the hair as it is wound or for safety. An energy storage device such as a spring may be energised by the motor during winding up of the hair and then released by the control circuit at the end of the elapsed time, together with the clutch, to unwind the hair.

Aspects of the present invention have been described by way of example only and it should be appreciated that modifications and additions may be made thereto without departing from the scope thereof.

The invention claimed is:

1. A hair styling iron comprising:

a barrel;

a handle on which the barrel is mounted, a heating element in the barrel;

a rotary drive that rotates the barrel;

a control circuit including a timer; and a drive switch which is user-actuable and connected to the control circuit for controlling operation of the rotary drive, wherein the control circuit monitors at least one change of state of the drive switch to determine a starting time, and actuates a response after an elapsed time, measured from the starting time, the rotary drive rotates the barrel in a first direction upon actuation of the drive switch, the control circuit records a first angle of rotation in the first direction, the response initiated by the control circuit after the elapsed time comprises turning the barrel in a second direction, opposite to the first direction, and the barrel is driven in the second direction through a second angle of rotation that is proportional to the first angle.

2. The hair styling iron of claim 1 comprising an alarm actuated by the control circuit after the elapsed time.

3. The hair styling iron of claim 1 wherein the second angle of rotation of the barrel is between 80 percent and 110 percent of the first angle of rotation of the barrel.

4. The hair styling iron of claim 1 wherein the drive switch provides on-off control of the rotary drive and, when turned on, the rotary drive moves the barrel at a substantially fixed rate.

5. The hair styling iron of claim 4 wherein the drive switch is a momentary switch, actuation of which must be maintained to operate the rotary drive.

6. The hair styling iron of claim 5 wherein actuation or release of the drive switch defines the starting time.

7. The hair styling iron of claim 2 wherein the change of state of the drive switch comprises first actuation of the drive switch.

8. The hair styling iron of claim 2 wherein the change of state of the drive switch comprises release of the drive switch immediately following first actuation of the drive switch.

9. The hair styling iron of claim 1 wherein the control circuit further comprises timer setting means for selecting one from a plurality of predetermined timer setting values, and each timer setting value is associated with a respective elapsed time.

10. The hair styling iron of claim 9 wherein the timer-setting means comprises a timer-setting switch connected to the control circuit.

11. The hair styling iron of claim 10 wherein the timer-setting switch comprises a single-pole, single-throw instantaneous contact switch that is mounted on the handle and toggles through a set of timer settings.

12. The hair styling iron of claim 9 wherein the control circuit comprises a thermostat, and means for selecting one from a plurality of setpoint temperatures, and each of the plurality of predetermined timer setting values is associated with both a respective elapsed time and a respective setpoint temperature.

13. The hair styling iron of claim 8 wherein the change of state comprises both the first actuation of the drive switch, and the release of the drive switch immediately following the first actuation of the drive switch, and the control circuit calculates the elapsed time in direct proportion to the first angle of rotation of the barrel in the first direction relative to the handle that occurs between the first actuation and the release of the drive switch.

14. The hair styling iron of claim 13 wherein the rotary drive rotates the barrel at a constant speed when the drive switch is actuated, and the angle of rotation of the barrel is directly proportional to time between the first actuation and the release of the drive switch, so the control circuit may monitor switch-operating time between the first actuation and the release of the drive switch and calculate the elapsed time in direct proportion to the switch operating time.

15. The hair styling iron of claim 8 wherein the drive switch provides modulated control of the rotary drive, and the control circuit includes a rotary encoder for measuring angle of rotation of the barrel.

16. The hair styling iron of claim 13 wherein the control circuit comprises a thermostat, and means for selecting one from a plurality of setpoint temperatures, and the elapsed time, which is calculated by the control circuit, is varied in proportion to the setpoint temperature.

17. The hair styling iron of claim 2 wherein the alarm is selected from the group consisting of a vibrator, an audio emitter, and a light source.

18. The hair styling iron of claim 1 including a display connected to the control circuit.

19. The hair styling iron of claim 18 wherein the display indicates at least one of a user-selected temperature and a user-selected timer setting.

20. A method of curling hair using a hair styling iron as claimed in claim 1, the method comprising:

a) heating the barrel;

b) wrapping a tress around the barrel;

c) actuating the drive switch to wind the tress about the barrel in the first direction, d) releasing the drive switch to stop the rotary drive, and e) receiving an automatically generated signal indicating the end of the elapsed time, and reversing the rotary drive, in response to the automatically generated signal, to turn the barrel in the second direction, thereby unwinding the tress from the barrel.

21. A hair styling iron comprising:

a barrel;

a handle on which the barrel is mounted;

a heating element in the barrel;

a rotary drive that rotates the barrel;

a control circuit including a timer; and a drive switch which is user actuable and connected to the control circuit for providing on-off control of the rotary drive, wherein the drive switch is a momentary switch, actuation of the drive switch must be maintained to operate the rotary drive, and, when the drive switch is actuated, the barrel is turned by the rotary drive at a substantially fixed rate, the control circuit monitors actuation of the drive switch to determine a starting time, and actuates an alarm after an elapsed time measured from the starting time, the rotary drive turns the barrel in a first direction upon actuation of the drive switch, and, after release of the drive switch, the control circuit activates the rotary drive to turn the barrel in a second direction, opposite to the first direction, and the control circuit records a first angle of rotation of the barrel in the first direction, and the barrel is driven in the second direction through a second angle that is proportional to the first angle of rotation of the barrel.

22. The hair styling iron of claim 21 wherein the second angle of rotation of the barrel is between 80 percent and 110 percent of the first angle of rotation of the barrel.

* * * * *